US005547072A

United States Patent [19]

Kaiser

[11] Patent Number: 5,547,072

[45] Date of Patent: Aug. 20, 1996

[54] JEWELRY BOX WITH REMOVABLE DISPLAY PLATFORM

[76] Inventor: Burton Kaiser, 2501 N. Wayne #1, Chicago, Ill. 60614

[21] Appl. No.: 253,897

[22] Filed: Jun. 3, 1994

[51] Int. Cl.[6] ..... B65D 5/50; A45C 11/16

[52] U.S. Cl. ..... 206/765; 206/6.1

[58] Field of Search ..... 206/45.13, 45.28, 206/6.1, 566, 45.19; 220/379

[56] References Cited

U.S. PATENT DOCUMENTS

| | | | |
|---|---|---|---|
| 791,322 | 5/1905 | Roth . | |
| 886,608 | 5/1908 | Jersemann | 206/566 X |
| 1,281,922 | 10/1918 | Fairbanks . | |
| 1,496,542 | 6/1924 | Jersemann | 206/566 X |
| 1,508,337 | 9/1924 | Jensen | 206/45.28 |
| 1,681,755 | 8/1928 | Warner et al. | 206/566 X |
| 2,240,645 | 5/1941 | Greig | 206/45.28 X |
| 2,324,310 | 7/1943 | McGovern . | |
| 2,464,161 | 3/1949 | Trachtenberg . | |
| 2,540,969 | 2/1951 | Tylon . | |
| 2,709,517 | 5/1955 | Young | 206/45.19 |
| 3,930,576 | 1/1976 | Stephens | 206/45 |
| 4,043,449 | 8/1977 | Love | 206/566 X |
| 4,101,023 | 7/1978 | Schaunder . | |
| 4,311,235 | 1/1982 | Titus | 206/566 X |
| 4,646,920 | 3/1987 | Kruger | 211/13 |
| 4,732,269 | 3/1988 | Roy | 206/566 X |
| 5,323,900 | 6/1994 | Atkins et al. | 206/365 |

FOREIGN PATENT DOCUMENTS

| | | |
|---|---|---|
| 0329229 | 4/1958 | Denmark . |
| 0412249 | 7/1910 | France . |
| 0278254 | 10/1927 | United Kingdom . |

*Primary Examiner*—Ted Kavanaugh

[57] ABSTRACT

A container comprising a bottom member, a separate cover and a removable display platform. The display platform having pins on the upper surface to receive the cover. The cover when engaged with the pins allow the cover to be supported thereon and also permit removal of the display platform from the bottom member by using the cover as a handle.

10 Claims, 3 Drawing Sheets

FIG.1
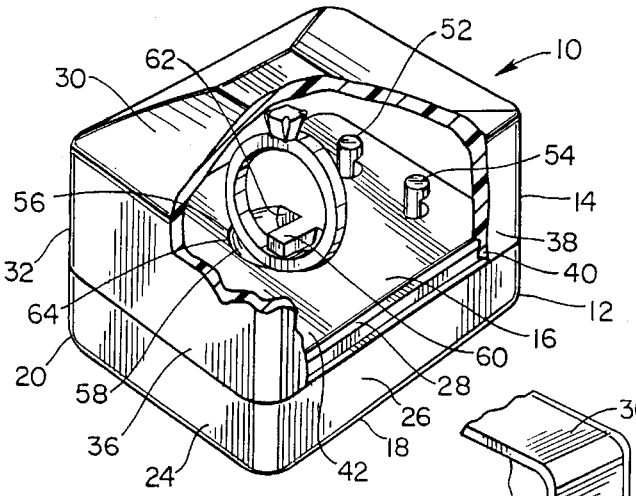
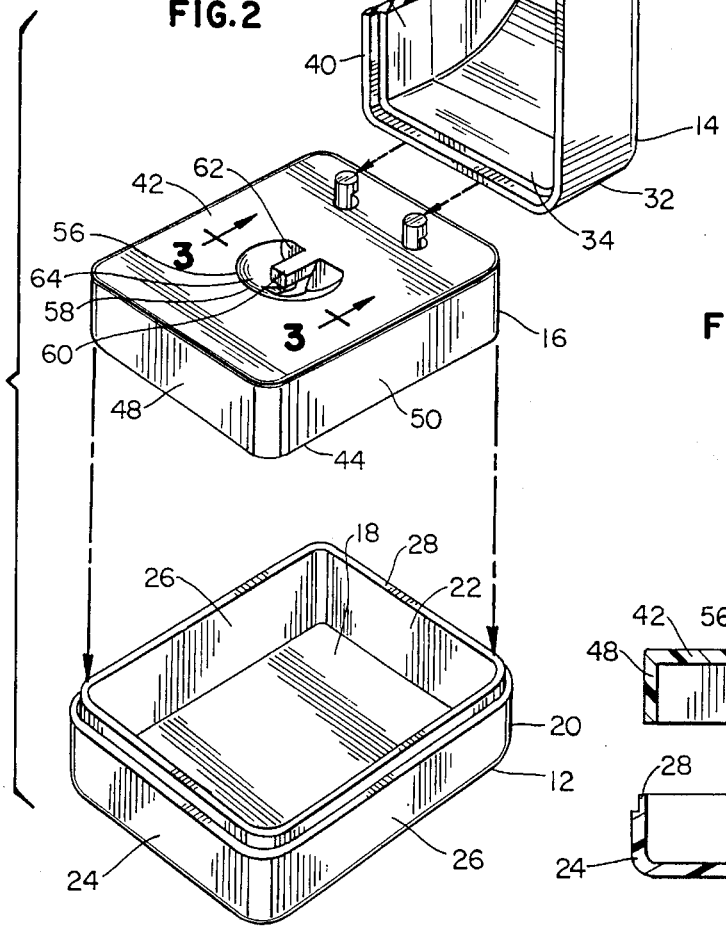
FIG.2
FIG.3
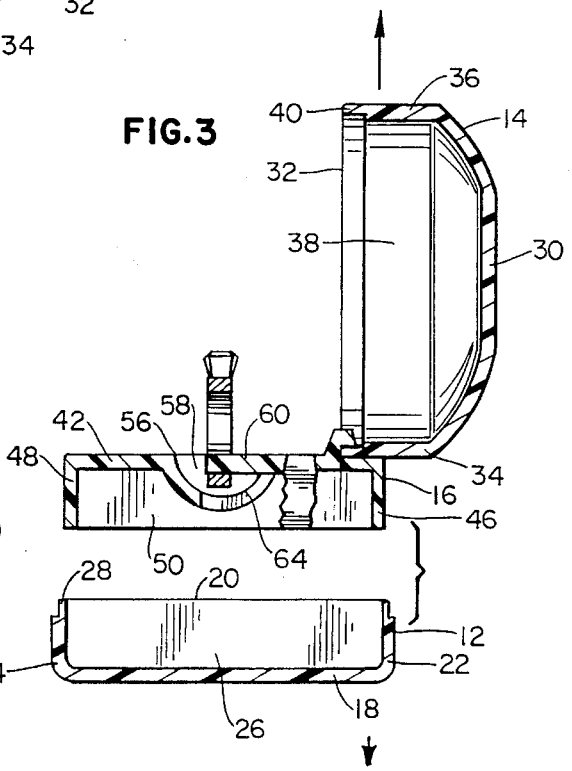

JEWELRY BOX WITH REMOVABLE DISPLAY PLATFORM

TECHNICAL FIELD

The invention relates to the field of jewelry boxes and in particular to jewelry boxes and display platforms that may be used to display jewelry including rings, necklaces or earrings.

BACKGROUND OF THE INVENTION

Traditionally, a jewelry box includes a container (box bottom), a cover (lid) attached by a hinge to or simply seated upon the container and a removable display platform fitted into the container. An article of jewelry is mounted and displayed on the display platform either by inserting the article into a slot or hole in the display platform or under a tab on the display platform.

The display platform is generally a box-like liner open on the bottom or a flat panel or padding that fits into the box bottom. The display platform is usually made of flexible material such as plastic, cardboard or similar material. The exposed surface of the display platform is generally covered with velvet, felt or other decorative material.

The display platform, usually frictionally mounted in the box bottom, can be removed from the box bottom by grasping a tab and lifting the platform from the box bottom or wedging a finger or instrument under the edge of the platform and shifting the platform within the box bottom such that an edge of the platform can be grasped and the platform lifted out of the box bottom.

The jewelry box has dual functions. When it is open, it serves as a display case. When it is closed, it serves as a gift and storage package for the enclosed article of jewelry. It is desirable that the jewelry box, as a display case or package, be attractive and elegant. While jewelry boxes have been made of a variety of materials, including wood, plastic, stone, metal and paper, the goal is to create an affordable box that will attract attention to and enhance the appearance of the jewelry displayed within the box.

The costs encountered when manufacturing a jewelry box come from both the materials and the labor used in constructing the box.

Typically, the container and lid of a jewelry box are joined by a hinge. The cost of the materials such as metal, plastic, fabric or paper having sufficient quality to be used in constructing a hinge is a major concern. In some cases, the cost of the hinge material can actually exceed the costs of constructing the rest of the jewelry box.

In addition, the assembly of a hinge can be one of the most labor intensive steps in the construction of a jewelry box. As such, the cost of labor used to assemble hinges adds another major expense to the construction of the jewelry boxes.

Display platforms or panels used to hold the articles of jewelry being stored or displayed within the jewelry boxes are commonly constructed of a flexible core material such as cardboard or paper and covered with a decorative material such as fabric or paper. The platform is removed from the box by either grasping a small tab and lifting the platform or by prying the edge of the platform up until a finger or other instrument can be slipped under the platform to lift it out. Often times, removing the platform can prove to be a difficult feat. In addition, the platform may be damaged during removal, thereby rendering it useless for future use.

In most situations it is also desirable that the cost of the box be negligible in comparison to the cost of the jewelry displayed with the jewelry box. One solution to the expense of the jewelry box has been for retailers to sell an article of jewelry and provide only the display platform to the customer. The box is retained by the retailer to be used to display another article of jewelry.

SUMMARY OF THE INVENTION

It is therefore an object of the present invention to provide a jewelry box with a removable display platform in which the display platform can support the cover of the jewelry box without a hinge.

It is a further object of the present invention to provide a jewelry box with a removable display platform in which the jewelry box cover serves as a handle by which the display platform can be removed from the box bottom.

It is also an object of the present invention to provide a jewelry box in which the cover and box bottom are hingedly attached by a spring and includes a removable display platform that can be tipped out of box bottom.

BRIEF DESCRIPTION OF THE DRAWINGS

FIG. 1 is a side elevation of the box with the cover closed, part of the cover being broken away to show the positions of the article of jewelry and pins when the box is closed;

FIG. 2 is an exploded view of a box according to an embodiment of this invention;

FIG. 3 is a cross-sectional exploded view of the side of the box showing the positions of the article of jewelry and the cover supported in the pin or pins on the display platform;

DETAILED DESCRIPTION OF THE INVENTION

Figure 6:
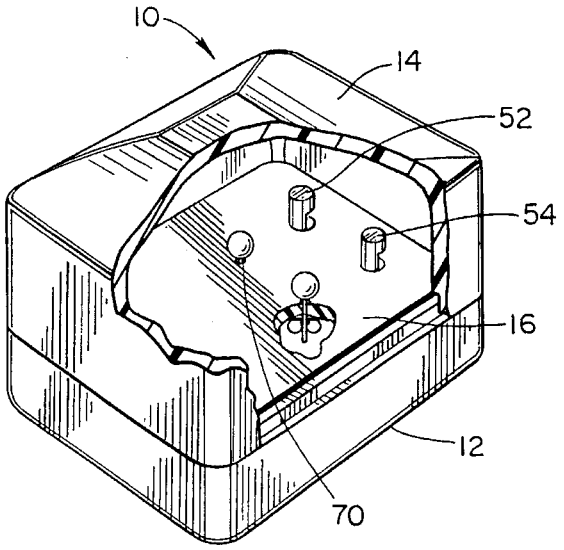
FIG. 6 is a side elevation of the box with the cover closed, part of the cover being broken away showing the positions of the article of jewelry and pins when the box is closed.

A jewelry box 10 of the present invention having a box bottom 12, a cover 14 and a display platform 16 is illustrated in FIGS. 1–3. It should be noted that the jewelry box 10 may be molded or otherwise constructed in any of a variety of desired shapes.

The box bottom includes a horizontal bottom wall 18 from which a peripheral wall 20 extends upwardly. The peripheral wall 20 comprises a rear wall 22, a front wall 24 and side walls referred to generally as 26. The upwardly facing edge portion of the peripheral wall 20 is stepped down at its outer edge from a marginal flange 28.

In the closed position, the cover 14 includes a horizontal top wall 30 from which a peripheral wall 32 extends downwardly. The peripheral wall 32 comprises a rear wall 34, a front wall 36 and side walls referred to generally as 38. The downwardly facing edge portion of the peripheral wall 32 is stepped down at its inner edge to form a marginal flange 40. When the cover 14 is in the closed position, as shown in FIG. 1, flange 40 engages flange 28 to frictionally hold the cover 14 in place on the box bottom 12. It is obvious that the positions of flanges 28 and 40 can be easily reversed in the present invention.

The display platform 16 includes a horizontal top wall 42 from which a peripheral wall 44 extends downwardly. The peripheral wall 44 comprises a rear wall 46, a front wall 48 and sidewalls referred to generally as 50. The display platform 16 is secured within the peripheral wall 20 of the box bottom 12 such that the outer surface of the peripheral wall 44 is in contact with the inner surface of the peripheral wall 20.

In accordance with a first embodiment of the invention, the display platform 16, as illustrated in FIGS. 1–3, includes two hooks 52 and 54. The hooks 52 and 54 open toward the rear wall 46 of the display platform 16. The flange 40 of the rear wall 34, side wall 38 or front wall 36 of the cover 14 may be engaged in the hooks 52 and 54 as shown in FIG. 3. When the flange 40 of the cover 14 is engaged in the hooks 52 and 54, the cover 14 is held in a vertical position relative to the horizontal box bottom 12. As such, the cover 14 is in the position to display the articles of jewelry detachable mounted on the display platform 16.

In addition, when the flange 40 of the cover 14 is engaged in the hooks 52 and 54, the cover 14 may serve as a handle by which the display platform 16 may be easily lifted from the box bottom 12. As such, this allows the display platform 16 to be made of a non-flexible material that does not need to be covered with velvet or other decorative material to create an inexpensive but attractive display for jewelry.

Another embodiment of the present invention which is not shown includes a jewelry box in which the top wall 42 of the display platform 16 extends above the peripheral wall 20 of the box bottom 12. The upper edge of the exposed portion of the rear wall 46 of the display platform 16 may include one or more slots by which the cover 14 is supported for display and lifting purposes.

The display platform 16 illustrated in FIGS. 1–3 also includes a ring holder 56. The ring holder 56 can be adapted to display other articles of jewelry such as bracelets. The holder 56 includes an upwardly-facing concavity 58. The shape of the concavity can range from a circular form as depicted in FIGS. 1–3 to a tear-shaped form (not shown) wherein the broader end faces the front wall 48 of the display platform 16.

A horizontal tab member 60 extends from the rear edge 62 of the concavity 58. A ring is frictionally retained between the tab member 60 and the upper surface 64 of the concavity 58. The shape of the tab member 60 can be varied. For example, the tab member 60 may be tapered from where it extends from the rear edge 62 of the concavity 58. In addition, the length of the tab member 60 can be varied to better accommodate the particular type of jewelry to be displayed.

Figure 4:
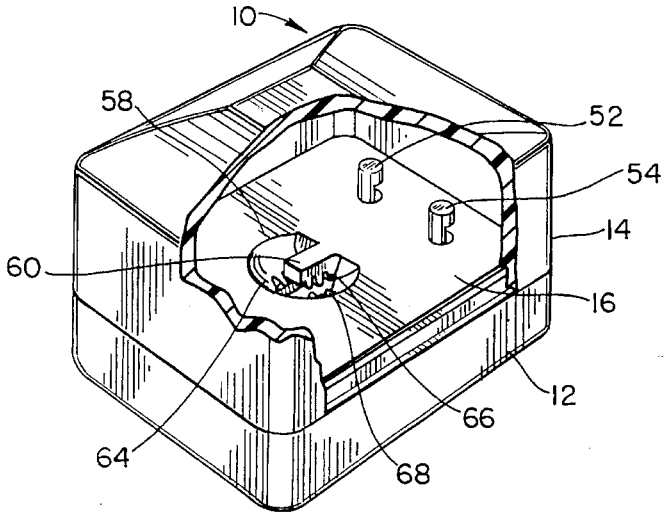
FIG. 4 is a right side elevation of the box with the cover closed, part of the cover being broken away showing the positions of the tab member and the pins when the box is closed.
Figure 5:
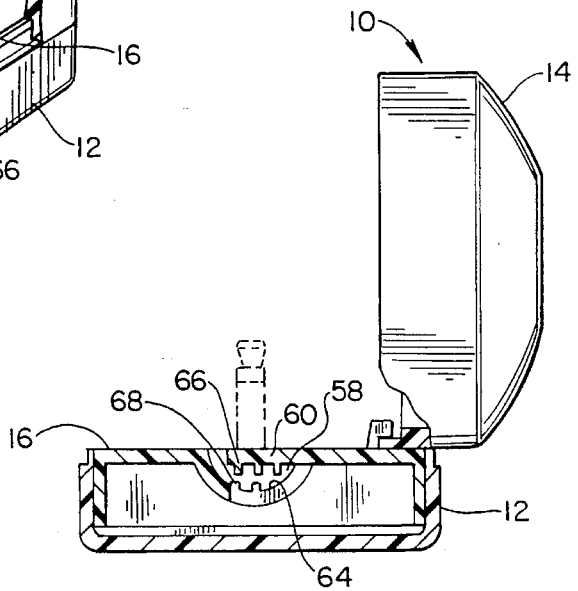
FIG. 5 is a cross-sectional view of the box showing the positions of the article of jewelry and the cover supported in the pin or pins on the display platform.

In another embodiment of the invention shown in FIGS. 4 and 5, the underside of the tab member 60 includes one or more protuberances, referred to generally as 66. Additional protuberances are located on the upper surface 64 of the concavity 58 and below the protuberances 66, referred to generally as 68. The protuberances 66 and 68 provide additional support for the jewelry detachably mounted on the display platform 16 during display and storage. Other embodiments of the invention may include only one of the sets of protuberances 66 and 68.

Figure 7:
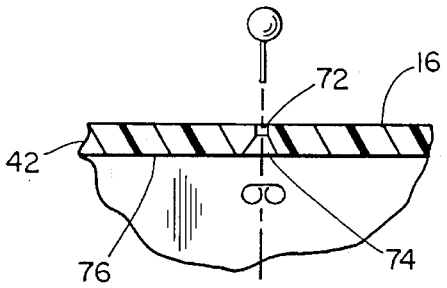
FIG. 7 a partial enlarged cross-sectional view of the display platform holding pierced earrings.

FIGS. 6 and 7 show a jewelry box 10 wherein the display platform 16 is adapted to display pierced earrings. Apertures 70 and 72 in the display platform 16 each open to a downwardly facing concavity 74 on the lower surface 76 of said top wall 42 of said platform 16. The post of a pierced earring is inserted through said aperture 70 or 72. The back of the earring is slid onto the post and sets into said concavity 74.

FIGS. 8–12 illustrate another embodiment of the present invention. Jewel box 10' includes a box bottom 76 to which a cover 78 is hinged and a display platform 80. The jewel box 10' can be molded or otherwise constructed in any variety of desired shapes.

The box bottom 76 includes a horizontal bottom wall 82 from which a peripheral wall 84 extends upwardly. The peripheral wall 84 comprises a rear wall 86, a front wall 88 and side walls referred to generally as 90. The upwardly facing edge portion of the peripheral wall 84 is stepped down at its inner edge to form a marginal flange 92. The inner surfaces of the rear wall 86 and the side walls 90 include projections 94 and 96, respectively.

Figure 8:
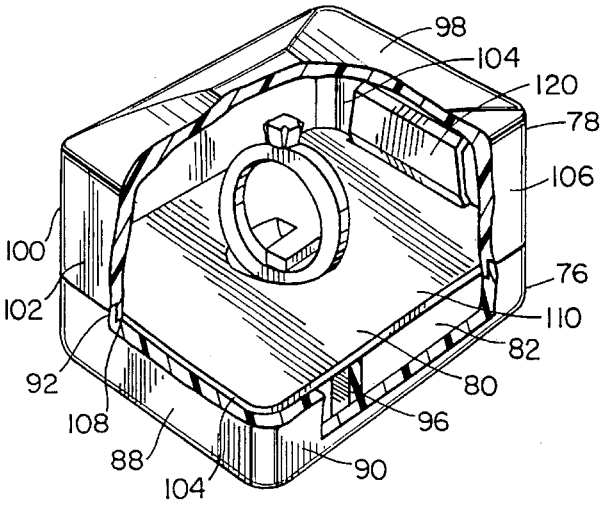
FIG. 8 is a side elevation of another embodiment of the box with the cover closed, part of the cover being broken away showing the positions of the article of jewelry and display platform when the box is closed.
Figure 10:
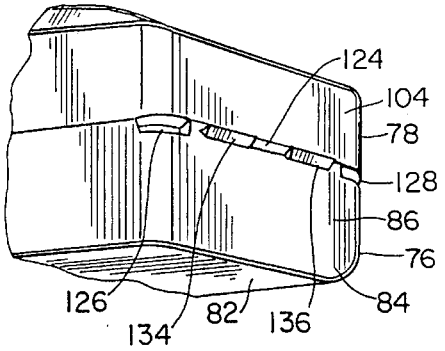
FIG. 10 is a partial bottom perspective of the box in FIG. 9.

In the closed position, the cover 78 includes a horizontal top wall 98 from which a peripheral wall 100 extends downwardly. The peripheral wall 100 comprises a rear wall 102, a front wall 104 and side walls referred to generally as 106. The downwardly-facing edge portion of the peripheral wall 100 is stepped down at its outer edge to form a marginal flange 108. When the cover 78 is in the closed position, as shown in FIG. 8, flange 108 engages flange 92 to frictionally hold the cover 78 in place on the box bottom 76.

In additional embodiments of the invention, the positions of flanges 92 and 108 are reversed or the flanges 92 and 108 are not included.

The display platform 80 comprises a horizontal wall 110 and is secured within the peripheral wall 84 of the box bottom 76 such that the outer edge of the wall 110 of the display platform 80 is in contact with the inner surface of the peripheral wall 84. The lower surface of the wall 110 rests on the upper surfaces of the projections 94 and 96. The rear edge 138 of the wall 110 includes a notch 122 to accommodate a spring 120. The lower surface of the front edge 140 of the display platform 80 includes an angular portion extending to the front edge 140.

The rear wall 86 of the box bottom 76 has at the central portion of its upper edge spaced lips 112 and 114 rotatably engaged in spaced grooves 116 and 118 at the central portion of the lower edge of the rear wall 104 of the cover 78.

The central portion of the lower edge of the rear wall 104 of the cover 78 includes a notch 124 which enables the lower edge of the rear wall 104 of the cover 78 to clear the edge of lips 112 and 114 of the rear wall 86. The upper edges of the end portion of the rear wall 86 include notches 126 and 128 which enable the lower edge of the rear wall 104 to clear the upper edge of the rear wall 86.

At the central portion of the inner surface of the rear wall 86 is a horizontal indentation or groove 130. At the central portion of the inner surface of the rear wall 104 is a similar horizontal indentation or groove 132 coextensive with groove 130. A curved overcenter spring 120 has ends hooked into the grooves 130 and 132 which keeps the cover 78 closed when the cover 78 is placed in the closed position and keeps the cover 78 open when the cover 78 is placed in the open position.

Figure 11:
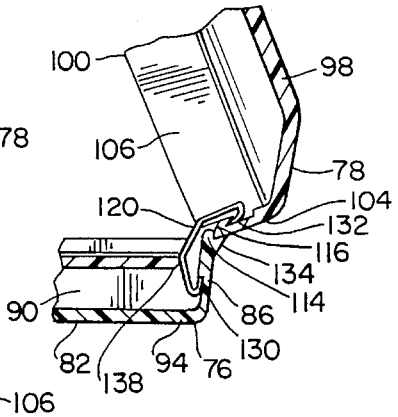
FIG. 11 is a partial enlarged cross-sectional view of the open box at the hinge between the box bottom and cover, with the display stand removed from the box.

The triangular shaped fulcrum lugs 134 and 136 located on the outer surface of the upper edge of the rear wall 86 and behind lips 112 and 114 support the lower edge of the rear wall 104 of the cover 78 when the cover 78 is in the open position. The lugs 134 and 136 prevent the over extension of the spring 120 that can occur when the cover 78 is pushed past its fully open position as shown in FIG. 11.

To remove the display platform 80, the front portion of the display platform 80 is depressed causing the platform to pivot on the projections 96. As the angular portion of the front edge 140 clears the front wall 88 of the box bottom 76, the rear edge 138 of the platform 80 is elevated above the peripheral wall 84. The rear edge 138 of the platform 80 can then be grasped or an instrument can be inserted under the edge 138 to lift the platform 80 from the box bottom 76.

In another embodiment of the invention (not shown in the drawings), the inner surfaces of the front wall 88 and the side walls 90 include projections similar to projections 94 and 96, respectively. The platform 80 is secured within the peripheral wall 84 of the box bottom 76 and rests on the projections 94 and 96. To remove the display platform 80, the rear portion of the platform 80 is depressed causing the platform to pivot on the projections 96. As the angular portion of the rear edge 138 clears the rear wall 86, the front edge 140 of the platform 80 is elevated above the peripheral wall 84. The front edge 140 of the platform 80 can then be grasped or an instrument can be inserted under the edge 140 to lift the platform 80 from the box bottom 76.

Figure 9:
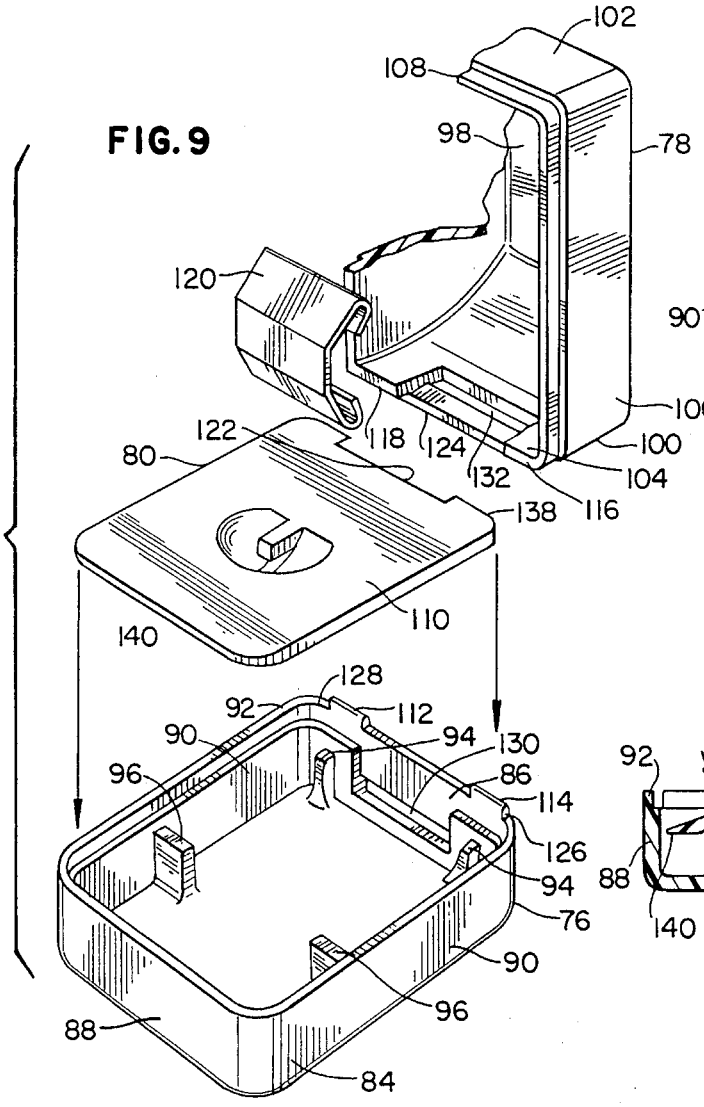
FIG. 9 is an exploded view of a box according to an embodiment of this invention.
Figure 12:
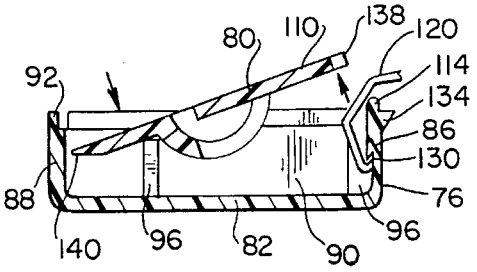
FIG. 12 is a cross-sectional view of the side of the box bottom and display platform.

The platform 80 can be adapted to display other types of jewelry other than rings as illustrated in FIGS. 8, 9 and 12.

This invention provides substantial advantages in that non-flexible materials can be used for the display platforms 16 and 80. In addition, the cost to manufacture attractive jewelry boxes can be reduced by using plastic materials when compared to the cost of manufacture of other jewelry boxes known in the art.

Whereas the present invention has been described with respect to specific embodiments thereof, it will be understood that various changes and modifications will be suggested to one skilled in the art and it is intended that the invention encompass such changes and modifications as fall within the scope of the appended claims.

I claim:

1. A container comprising:

a bottom member;

a removable display platform adapted to be fitted within the bottom member;

a separate cover adapted to fit on the bottom member in a closed position;

said display platform comprising means for receiving an edge of said cover and supporting said cover in an open position; and means for removing the display platform from the bottom member using the cover as a handle.

2. A container comprising:

a bottom member;

a removable display platform adapted to be fitted within the bottom member;

a separate cover adapted to fit on the bottom member in a closed position; and said display platform comprising means for receiving an edge of said cover and supporting said cover in an open position, wherein said means for receiving and supporting comprises at least one pin affixed to the upper surface of said display platform.

3. A container comprising:

a bottom member;

a separate cover adapted to fit on the bottom member in a closed position;

a removable display platform adapted to be fitted within the bottom member wherein the upper surface of said display platform includes a concavity and a tab extending from an edge of said concavity; and means affixed to the upper surface of said display platform for receiving an edge of said cover and supporting said cover in an open position.

4. A container as set forth in claim 3, wherein said display platform is adapted to be frictionally held within said bottom member.

5. A container as set forth in claim 3 wherein the lower surface of said tab includes at least one protuberance.

6. A container as set forth in claim 3 wherein the upper surface of said concavity includes at least one protuberance.

7. A container as set forth in claim 6 wherein the lower surface of said tab includes at least one protuberance.

8. A container as set forth in claim 3 wherein said means for receiving said edge of said cover and supporting said cover in an open position comprises at least one pin.

9. A container as set forth in claim 8, wherein said pin is proximate to the rear edge of said display platform.

10. A container as set forth in claim 3 wherein said means for receiving and supporting is adapted to permit removal of the display platform from the bottom member using the cover as a handle.

* * * * *